US008627791B2

(12) United States Patent
Janak et al.

(10) Patent No.: US 8,627,791 B2
(45) Date of Patent: Jan. 14, 2014

(54) PRIMARY AND AUXILIARY ROCKER ARM ASSEMBLY FOR ENGINE VALVE ACTUATION

(75) Inventors: Robb Janak, Bristol, CT (US); Brian Ruggiero, East Granby, CT (US); Zdenek S. Meistrick, West Granby, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 0 days.

(21) Appl. No.: 13/481,026

(22) Filed: May 25, 2012

(65) Prior Publication Data

US 2012/0298057 A1 Nov. 29, 2012

Related U.S. Application Data

(60) Provisional application No. 61/490,544, filed on May 26, 2011.

(51) Int. Cl.
*F01L 1/34* (2006.01)

(52) U.S. Cl.
USPC ..... 123/90.16; 123/90.39

(58) Field of Classification Search
USPC ..... 123/90.6, 90.16; 74/567, 569, 559
See application file for complete search history.

(56) References Cited

U.S. PATENT DOCUMENTS

| | | | | |
|---|---|---|---|---|
| 3,220,392 | A | 11/1965 | Cummins | |
| 5,680,841 | A | 10/1997 | Hu | |
| 6,386,160 | B1 * | 5/2002 | Meneely et al. | 123/90.16 |
| 6,983,725 | B2 | 1/2006 | Persson | |
| 7,392,772 | B2 | 7/2008 | Janak et al. | |
| 7,712,449 | B1 | 5/2010 | Schwoerer | |

FOREIGN PATENT DOCUMENTS

| | | |
|---|---|---|
| WO | 2010126479 | 11/2010 |

* cited by examiner

*Primary Examiner* — Zelalem Eshete
(74) *Attorney, Agent, or Firm* — Kelley Drye & Warren LLP

(57) ABSTRACT

Systems and methods for actuating engine valves are disclosed. The systems may include primary and auxiliary rocker arms disposed adjacent to each other on a rocker arm shaft. The primary rocker arm may actuate engine valves for primary valve actuation motions, such as main exhaust events, in response to an input from a first valve train element, such as a cam. The auxiliary rocker arm may receive one or more auxiliary valve actuation motions, such as for engine braking, exhaust gas recirculation, and/or brake gas recirculation events, from a second valve train element to actuate one of the engine valves. Master and slave pistons may be provided in the primary rocker arm. The master piston may be actuated by the auxiliary rocker arm.

23 Claims, 3 Drawing Sheets

PRIMARY AND AUXILIARY ROCKER ARM ASSEMBLY FOR ENGINE VALVE ACTUATION

CROSS REFERENCE TO RELATED APPLICATIONS

This application relates to, and claims the benefit of the earlier filing date and priority of U.S. Provisional Patent Application No. 61/490,544, filed on May 26, 2011, and entitled "Primary And Half Rocker Arm Assembly For Engine Valve Actuation."

FIELD OF THE INVENTION

The present invention relates to systems and methods for actuating poppet valves in internal combustion engines.

BACKGROUND OF THE INVENTION

Internal combustion engines typically use either a mechanical, electrical, or hydro-mechanical valve actuation system to actuate the engine valves. These systems may include a combination of camshafts, rocker arms and push rods that are driven by the engine's crankshaft rotation. When a camshaft is used to actuate the engine valves, the timing of the valve actuation may be fixed by the size and location of the lobes on the camshaft.

For each 360 degree rotation of the camshaft, the engine completes a full cycle made up of four strokes (i.e., expansion, exhaust, intake, and compression). Both the intake and exhaust valves may be closed, and remain closed, during most of the expansion stroke wherein the piston is traveling away from the cylinder head (i.e., the volume between the cylinder head and the piston head is increasing). During positive power operation, fuel is burned during the expansion stroke and positive power is delivered by the engine. The expansion stroke ends at the bottom dead center point, at which time the piston reverses direction and the exhaust valve may be opened for a main exhaust event. A lobe on the camshaft may be synchronized to open the exhaust valve for the main exhaust event as the piston travels upward and forces combustion gases out of the cylinder. Near the end of the exhaust stroke, another lobe on the camshaft may open the intake valve for the main intake event at which time the piston travels away from the cylinder head. The intake valve closes and the intake stroke ends when the piston is near bottom dead center. Both the intake and exhaust valves are closed as the piston again travels upward for the compression stroke.

The above-referenced main intake and main exhaust valve events are required for positive power operation of an internal combustion engine. Additional auxiliary valve events, while not required, may be desirable. For example, it may be desirable to actuate the intake and/or exhaust valves during positive power or other engine operation modes for compression-release engine braking, bleeder engine braking, exhaust gas recirculation (EGR), brake gas recirculation (BGR), or other auxiliary intake and/or exhaust valve events. FIG. 5 illustrates examples of a main exhaust event 600, and auxiliary valve events, such as a compression-release engine braking event 610, bleeder engine braking event 620, exhaust gas recirculation event 640, and brake gas recirculation event 630, which may be carried out by an engine valve using various embodiments of the present invention to actuate engine valves for main and auxiliary valve events.

With respect to auxiliary valve events, flow control of exhaust gas through an internal combustion engine has been used in order to provide vehicle engine braking. Generally, engine braking systems may control the flow of exhaust gas to incorporate the principles of compression-release type braking, exhaust gas recirculation, exhaust pressure regulation, and/or bleeder type braking.

During compression-release type engine braking, the exhaust valves may be selectively opened to convert, at least temporarily, a power producing internal combustion engine into a power absorbing air compressor. As a piston travels upward during its compression stroke, the gases that are trapped in the cylinder may be compressed. The compressed gases may oppose the upward motion of the piston. As the piston approaches the top dead center (TDC) position, at least one exhaust valve may be opened to release the compressed gases in the cylinder to the exhaust manifold, preventing the energy stored in the compressed gases from being returned to the engine on the subsequent expansion down-stroke. In doing so, the engine may develop retarding power to help slow the vehicle down. An example of a prior art compression release engine brake is provided by the disclosure of the Cummins, U.S. Pat. No. 3,220,392 (November 1965), which is hereby incorporated by reference.

During bleeder type engine braking, in addition to, and/or in place of, the main exhaust valve event, which occurs during the exhaust stroke of the piston, the exhaust valve(s) may be held slightly open during the remaining three engine cycles (full-cycle bleeder brake) or during a portion of the remaining three engine cycles (partial-cycle bleeder brake). The bleeding of cylinder gases in and out of the cylinder may act to retard the engine. Usually, the initial opening of the braking valve(s) in a bleeder braking operation is in advance of the compression TDC (i.e., early valve actuation) and then lift is held constant for a period of time. As such, a bleeder type engine brake may require lower force to actuate the valve(s) due to early valve actuation, and generate less noise due to continuous bleeding instead of the rapid blow-down of a compression-release type brake.

Exhaust gas recirculation (EGR) systems may allow a portion of the exhaust gases to flow back into the engine cylinder during positive power operation. EGR may be used to reduce the amount of $NO_x$ created by the engine during positive power operations. An EGR system can also be used to control the pressure and temperature in the exhaust manifold and engine cylinder during engine braking cycles. Generally, there are two types of EGR systems, internal and external. External EGR systems recirculate exhaust gases back into the engine cylinder through an intake valve(s). Internal EGR systems recirculate exhaust gases back into the engine cylinder through an exhaust valve(s) and/or an intake valve(s). Embodiments of the present invention primarily concern internal EGR systems.

Brake gas recirculation (BGR) systems may allow a portion of the exhaust gases to flow back into the engine cylinder during engine braking operation. Recirculation of exhaust gases back into the engine cylinder during the intake stroke, for example, may increase the mass of gases in the cylinder that are available for compression-release braking. As a result, BGR may increase the braking effect realized from the braking event.

SUMMARY OF THE INVENTION

Responsive to the foregoing challenges, Applicants have developed an innovative system for actuating first and second engine valves associated with the same engine cylinder, comprising: a rocker arm shaft; a means for imparting primary valve actuation motion; a primary rocker arm disposed on the rocker arm shaft, said primary rocker arm being adapted to actuate the first and second engine valves and receive motion from the means for imparting primary valve actuation motion; a means for imparting auxiliary valve actuation motion; an auxiliary rocker arm disposed adjacent to the primary rocker arm, said auxiliary rocker arm being adapted to receive motion from the means for imparting auxiliary valve actuation motion; a master piston disposed in a master piston bore in the primary rocker arm; a slave piston disposed in a slave piston bore in the primary rocker arm, said slave piston positioned so as to provide auxiliary valve actuation motion to only the first of the first and second engine valves; a control valve disposed in a control valve bore in the primary rocker arm; and a hydraulic circuit connecting the master piston bore, the slave piston bore and the control valve bore.

Applicants have further developed an innovative system for actuating first and second engine valves comprising: a rocker arm shaft; a primary rocker arm disposed on the rocker arm shaft, said primary rocker arm having a master piston boss extending laterally from a main body of the primary rocker arm; an auxiliary rocker arm disposed adjacent to the main body of the primary rocker arm on a side of the primary rocker arm from which the master piston boss extends; a master piston disposed in a master piston bore in the master piston boss; a slave piston disposed in a slave piston bore in the main body of the primary rocker arm; a valve bridge extending between the first and second engine valves, and having a center surface adapted to contact the primary rocker arm actuation end, said valve bridge further having a side opening extending through a first end of the valve bridge above the first engine valve; a sliding pin disposed in the valve bridge side opening and extending between and contacting the first engine valve and the slave piston; and a hydraulic circuit connecting the master piston bore, the slave piston bore and a hydraulic fluid source.

Applicants have still further developed an innovative method of actuating first and second engine valves for primary and auxiliary valve actuation events using a primary rocker arm, an auxiliary rocker arm mounted adjacent to the primary rocker arm, and a master-slave hydraulic lost motion system incorporated into the primary rocker arm, said method comprising the steps of: actuating the first and second engine valves for a primary valve actuation event responsive to motion imparted from a first valve train element to the primary rocker arm during a primary valve actuation mode of engine operation; applying hydraulic fluid to the master-slave hydraulic lost motion system to extend master and slave pistons from the primary rocker arm during a time that an auxiliary valve actuation event is to be imparted to only the first of the first and second engine valves; and actuating only the first of the first and second engine valves for an auxiliary valve actuation event using the master-slave hydraulic lost motion system responsive to motion imparted from a second valve train element to the auxiliary rocker arm during an auxiliary valve actuation mode of engine operation.

It is to be understood that both the foregoing general description and the following detailed description are exemplary and explanatory only, and are not restrictive of the invention as claimed.

BRIEF DESCRIPTION OF THE DRAWINGS

In order to assist the understanding of this invention, reference will now be made to the appended drawings, in which like reference characters refer to like elements.

DETAILED DESCRIPTION OF EMBODIMENTS OF THE INVENTION

Figure 1:
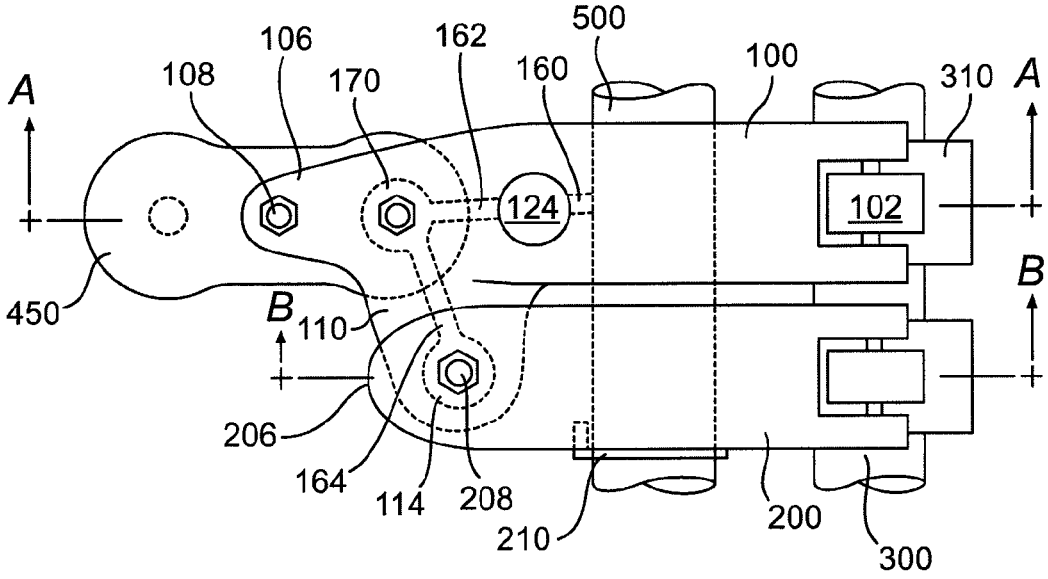
FIG. 1 is an top plan view of an master-slave rocker arm and auxiliary rocker arm system assembled in accordance with a first embodiment of the present invention.
Figure 2:
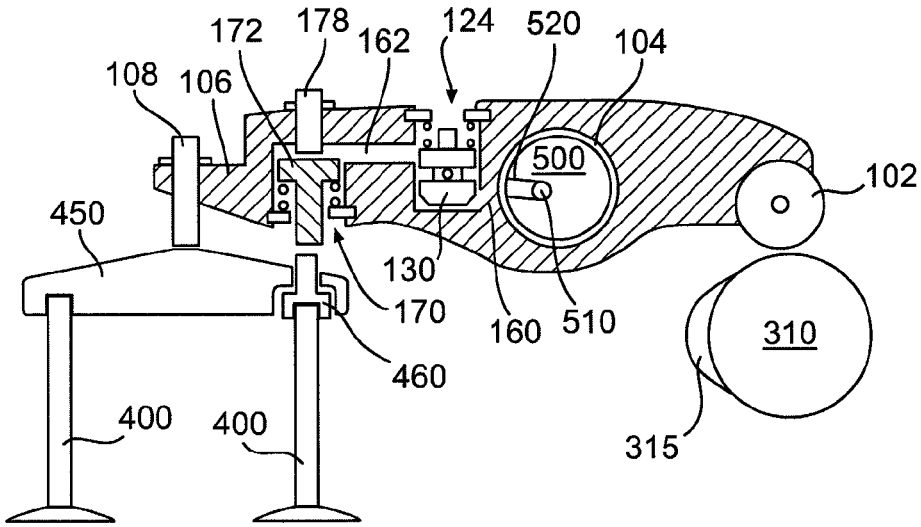
FIG. 2 is a partial cross-section of the embodiment of the present invention shown in FIG. 1 taken along cut line A-A.
Figure 3:
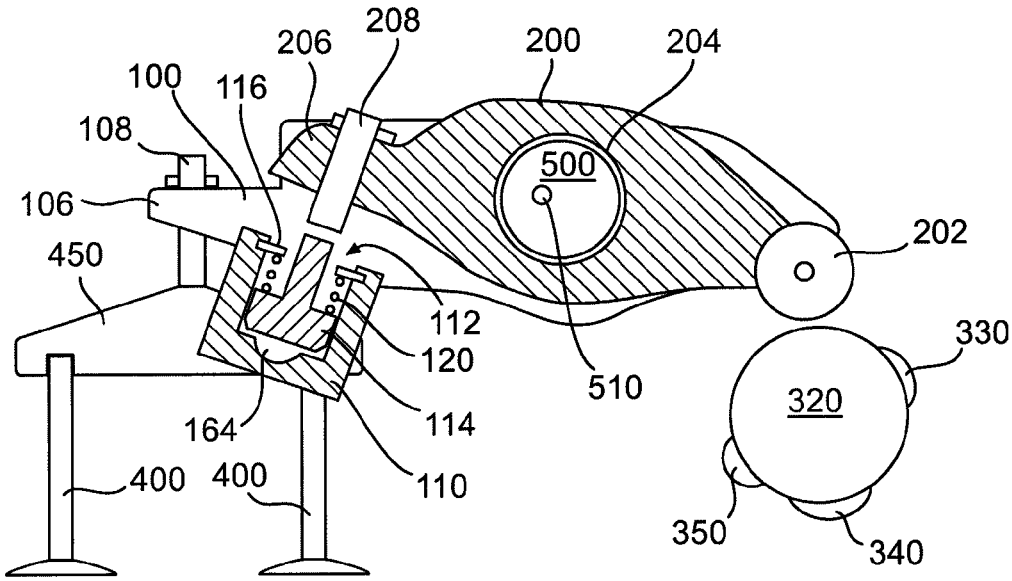
FIG. 3 is a partial cross-section of the embodiment of the present invention shown in FIG. 1 taken along cut line B-B.

Reference will now be made in detail to a first embodiment of the present invention, an example of which is illustrated in the accompanying drawings. With reference to FIG. 1, a system for actuating engine valves is shown. FIG. 1 is a top view of a primary rocker arm 100 which may be referred to as an exhaust rocker arm herein, but which is not limited to being an exhaust rocker arm. An auxiliary (or offset) rocker arm 200 is mounted adjacent to the primary rocker arm 100. FIG. 2 is a side view in partial cross-section of the exhaust rocker arm 100 taken along cut line A-A in FIG. 1. FIG. 3 is a side view in partial cross-section of the auxiliary rocker arm 200 taken along cut line B-B in FIG. 1. With reference to FIGS. 1-3, the engine valves 400 referenced constitute poppet-type valves that are used to control communication between the combustion chambers (e.g., cylinders) in an engine and aspirating (e.g., intake and exhaust) manifolds. The system includes a rocker arm shaft 500 on which the primary and auxiliary rocker arms 100 and 200 may be disposed. In an alternative embodiment, the primary and auxiliary rocker arms 100 and 200 may each be mounted on their own rocker shaft. The primary and auxiliary rocker arms 100 and 200 may be pivoted about the rocker arm shaft 500 as a result of motion imparted to them by a camshaft 300 or some other motion imparting means.

When the primary rocker arm 100 is an exhaust rocker arm, both it and the auxiliary rocker arm 200 may be adapted to actuate engine valves, such as an exhaust valves 400, by contacting them directly (not shown) or through a valve bridge 450 (shown). In such case, the auxiliary rocker arm 200 is adapted to selectively actuate at least one exhaust valve 400 by contacting a master piston 114 provided in the exhaust rocker arm 100 which is in hydraulic communication with a slave piston 172 in the exhaust rocker arm, and which in turn acts on a single exhaust valve of a set of two or more exhaust valves associated with the same engine cylinder through a sliding pin 460.

The rocker arm shaft 500 may include one or more internal passages for the delivery of hydraulic fluid, such as engine oil, to the rocker arms mounted thereon. Specifically, the rocker arm shaft 500 may include a control fluid supply passage 520. The control fluid supply passage 520 may provide hydraulic fluid to the master-slave hydraulic circuit in the exhaust rocker arm 100 through a rocker shaft passage 510. A solenoid control valve (not shown) may control the supply of low pressure hydraulic fluid to the control fluid supply passage 520.

With reference to both FIGS. 1 and 2, the exhaust rocker arm 100 includes a rocker shaft bore 104 extending laterally through a central portion of the rocker arm. The rocker shaft bore 104 may be adapted to receive the rocker arm shaft 500. The rocker shaft bore 104 may include one or more ports formed in the wall thereof to receive fluid from the control fluid supply passage 520 formed in the rocker arm shaft 500.

The exhaust rocker arm 100 may include a valve actuation end 106 having a lash adjustment screw 108. The lash adjustment screw 108 may protrude from the bottom of the valve actuation end 106 and permit adjustment of the lash space between the valve actuation end 106 of the exhaust rocker arm and the exhaust valve bridge 450. The lash adjustment screw may be locked in place by a nut. Optionally, a self-adjusting hydraulic lash adjuster may be substituted for the manually-adjustable lash adjustment screw, or lash adjustment may not be provided at all.

With reference to FIGS. 1-3, a master piston boss 110 may extend laterally from the valve actuation end 106 of the main body of the exhaust rocker arm so that it is positioned below the valve actuation end 206 of the auxiliary rocker arm 200. FIG. 3 is a side view in cross-section which shows the master piston boss 110. A master piston bore 112 may be formed in the boss 110 and a master piston 114 may be slidably disposed in the master piston bore 112. A master piston retaining cup 116 may be located near the open end of the master piston bore 112. The retaining cup 116 may have a central opening through which the master piston 114 may extend. The retaining cup 116 may be prevented from sliding out of the master piston bore 112 by a retaining washer. An optional spring 120 may extend between the retaining cup 116 and a shoulder provided on the master piston 114 so that the master piston is biased into the master piston bore 112. A fluid passage 164 may connect the master piston bore to a slave piston bore 170 or the fluid passage 162.

With reference to FIGS. 1-4, the exhaust rocker arm 100 may include a slave piston bore 170 adjacent to the master piston bore 112 and a slave piston 172 may be slidably disposed in the slave piston bore 170. A slave piston retaining cup 174 may be located near the open end of the slave piston bore 170. The retaining cup 174 may have a central opening through which the slave piston 172 may extend. The retaining cup 174 may be prevented from sliding out of the slave piston bore 170 by a retaining washer. An optional spring 176 may extend between the retaining cup 174 and a shoulder provided on the slave piston 172 so that the slave piston is biased into the slave piston bore 170. The fluid passage 164 may connect the slave piston bore 170 or the passage 162 extending from the slave piston bore to the master piston bore 112.

A lash adjustment screw 178 may extend through the exhaust rocker arm 100 to contact the slave piston 172. The lash adjustment screw 178 may protrude from the top of the valve actuation end 106 of the exhaust rocker arm and permit adjustment of the lash space between the lower end of the slave piston 172 and the sliding pin 460 in the exhaust valve bridge 450. The lash adjustment screw may be locked in place by a nut. Optionally, a self-adjusting hydraulic lash adjuster may be substituted for the manually-adjustable lash adjustment screw, or lash adjustment may not be provided at all.

The exhaust rocker arm 100 may also include a control valve bore 124 at the end of the rocker arm proximal to the valve actuation end 106. A control valve piston 130 may be disposed in a control valve bore 124. The control valve piston 130 may control the supply of hydraulic fluid to the master and slave hydraulic circuit which includes the master and slave piston bores 112 and 170, and the fluid passages 162 and 164. The control valve bore may be oriented vertically, as shown in FIGS. 2 and 4, or in an alternative embodiment, in some other orientation, such as horizontally.

Figure 4:
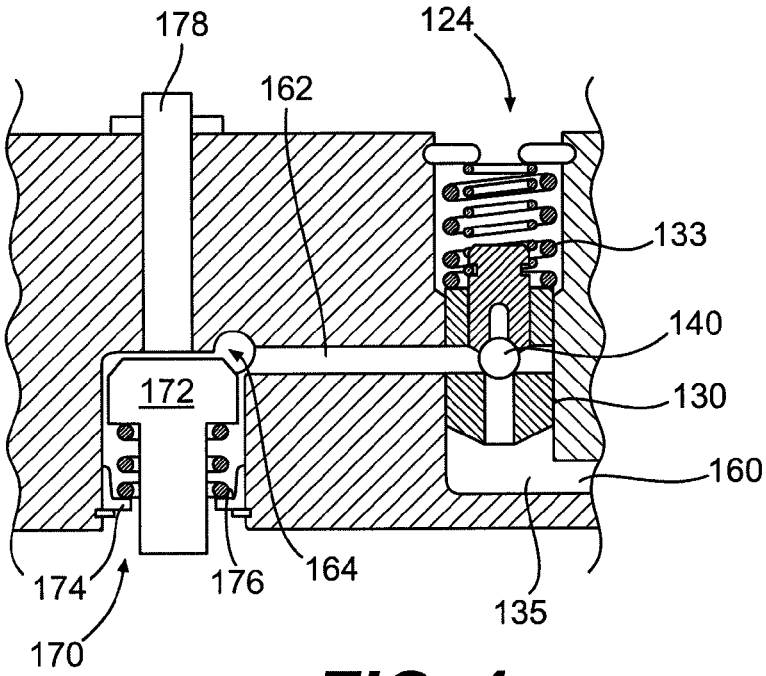
FIG. 4 is an enlarged view of the hydraulic control valve and slave piston circuit in the master-slave rocker arm shown in FIG. 1.
Figure 5:
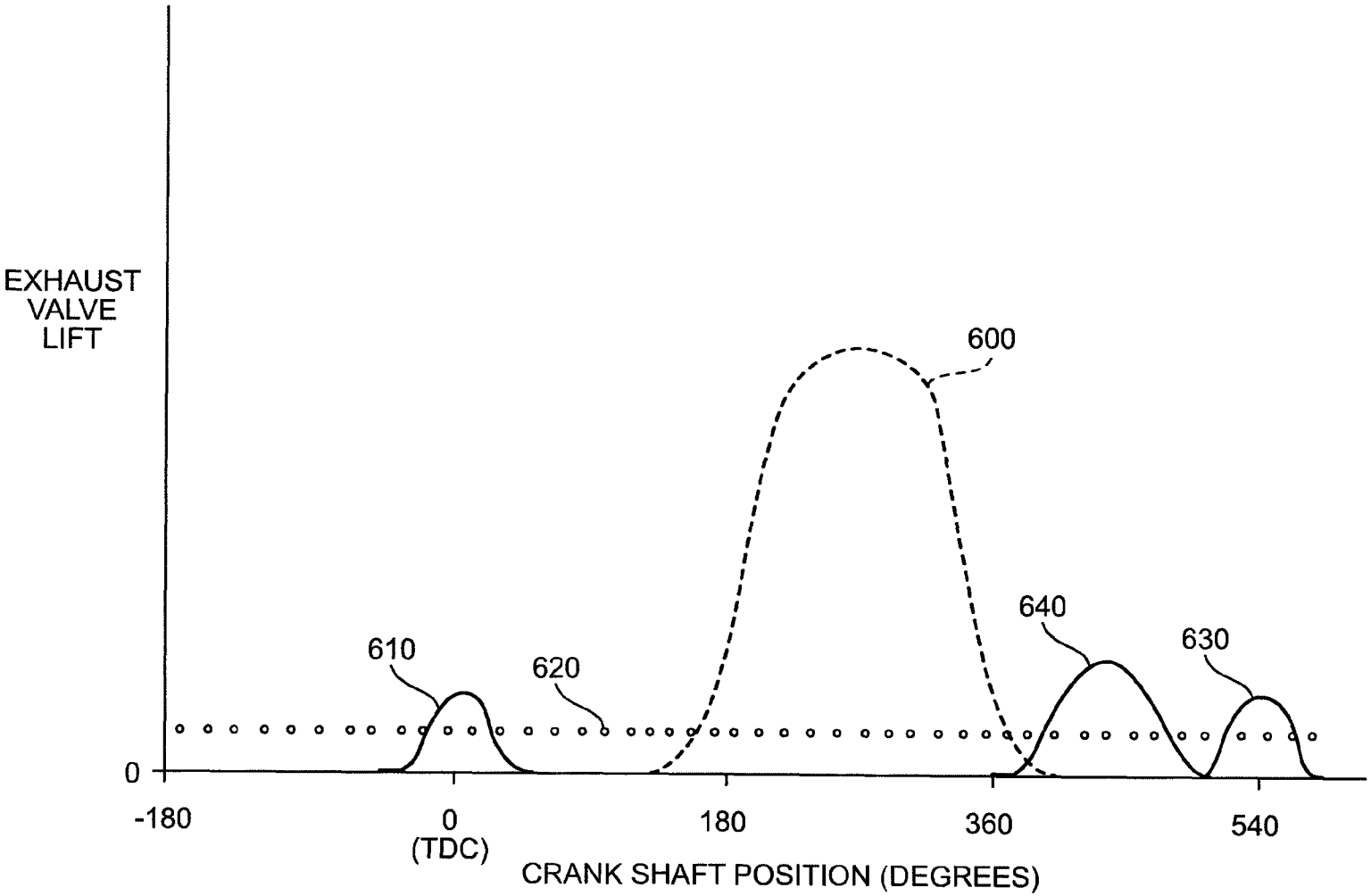
FIG. 5 is a graph of a number of different and exemplary auxiliary valve events.

FIG. 4 shows the details of the control valve piston 130 used in the first embodiment of the present invention. The control valve piston 130 may be a cylindrically shaped element with one or more internal passages, and which may incorporate an internal control check valve 140. The check valve 140 may permit fluid to pass from the control fluid passage 160 to the supply fluid passage 162, but not in the reverse direction. The control valve piston 130 may be spring biased by one or more control valve springs 133 into the control valve bore 124 into the bottom 135 of the control valve bore. A central internal passage may extend axially from the inner end of the control valve piston 130 towards the middle of the control valve piston where the control check valve 140 may be located. The central internal passage in the control valve piston 130 may communicate with one or more passages extending across the diameter of the control valve piston 130. As a result of the upward translation of the control valve piston 130 relative to its bore 124, as shown in FIG. 4, the passages extending through the control valve piston 130 may selectively register with a port that connects the side wall of the control valve bore with the second fluid passage 162. When the passages extending through the control valve piston 130 register with the second fluid passage 162, low pressure fluid may flow from the first fluid passage 160, through the control valve piston 130, and into the second fluid passage 162 to fill the master-slave hydraulic circuit.

The exhaust rocker arm 100 may include one or more internal passages 160, 162 and 164 for the delivery of hydraulic fluid through the exhaust rocker arm to fill the master-slave hydraulic circuit contained therein. A port at the end of the first fluid passage 160 may communicate with the rocker shaft bore 104 and may register with the control fluid supply passage 520 provided in the rocker arm shaft 500 when the exhaust rocker arm is mounted on the rocker arm shaft. The first fluid passage 160 may extend between the rocker shaft bore 104 and the control valve bore 124. The second fluid passage 162 may extend through the exhaust rocker arm 100 from the control valve bore 124 to the slave piston bore 170. The third fluid passage 164 may extend from the master piston bore 112 to the slave piston bore 170 or the second fluid passage 162. Taken together, the master piston, slave piston, and the hydraulic circuit connecting them may form a master-slave hydraulic lost motion system which is incorporated into the primary rocker arm 100.

With renewed reference to FIGS. 1 and 2, an exhaust rocker cam roller 102 may be connected to the exhaust rocker arm 100. The exhaust rocker cam roller 102 may contact an exhaust cam 310 (i.e., means for imparting primary valve actuation) provided on the cam shaft 300. The exhaust cam 310 may include one or more lobes, including a lobe adapted to produce a primary valve opening event, such as a main exhaust event, by imparting a primary valve actuation motion to the exhaust rocker arm 100. It is appreciated that the primary valve actuation motion may be imparted to the exhaust rocker arm 100 by any number of alternative valve train elements, including but not limited to cams, push tubes, rocker arms, levers, hydraulic and electro-mechanical actuators, and the like.

With reference to FIGS. 1 and 3, the auxiliary rocker arm 200 includes a rocker shaft bore 204 extending laterally through a central portion of the offset rocker arm. The rocker shaft bore 204 may be adapted to receive the rocker arm shaft 500. The auxiliary rocker arm 200 may further include a valve actuation end 206 and a lash adjustment screw 208. The lash adjustment screw 208 may protrude from the bottom of the valve actuation end 206 and permit adjustment of the lash space between the valve actuation end 206 of the auxiliary rocker arm and the master piston 114. The lash adjustment screw 208 may be locked in place by a nut. Optionally, a hydraulic or other self-adjusting lash adjuster may be substituted for the lash adjustment screw 208.

An auxiliary rocker cam roller 202 may be connected to the offset rocker arm 200. The auxiliary rocker cam roller 202 may contact an auxiliary cam 320 (i.e., means for providing auxiliary valve actuation) provided on the cam shaft 300. With reference to FIG. 4 in particular, the auxiliary cam 320 may include one or more cam lobes such as for example, an engine braking cam lobe 330, an exhaust gas recirculation (EGR) cam lobe 340, and/or a brake gas recirculation (BGR) cam lobe 350 adapted to impart one or more auxiliary valve actuation motions to the auxiliary rocker arm 200. It is appreciated that these auxiliary valve actuation motions may be imparted to the auxiliary actuator rocker arm 200 by any number of alternative valve train elements, including but not limited to cams, push tubes, rocker arms, levers, hydraulic and electro-mechanical actuators, and the like. The engine braking cam lobe 330 may be adapted to provide compression-release, bleeder, or partial bleeder engine braking. Compression-release engine braking involves opening an exhaust valve (or an auxiliary engine valve) near the top dead center position for the engine piston on compression strokes (and/or exhaust strokes for two-cycle braking) for the piston. Bleeder engine braking involves opening an exhaust valve for the complete engine cycle; and partial bleeder engine braking involves opening an exhaust valve for a significant portion of the engine cycle. The optional EGR lobe may be used to provide an EGR event during a positive power mode of engine operation. The optional BGR lobe may be used to provide a BGR event during an engine braking mode of engine operation. The valve actuation motions provided by the engine braking lobe 330, the EGR lobe 340, and the BGR lobe 350 are intended to be examples of auxiliary valve actuation motions that may be provided by the auxiliary rocker arm 200.

With reference to FIG. 1, a mousetrap type spring 210 may engage the auxiliary rocker arm 200 and the rocker shaft 500. As shown, the spring 210 may bias the auxiliary rocker arm 200 toward the cam shaft 300. The spring 210 may have sufficient strength to maintain the auxiliary rocker arm 200 in contact with the auxiliary cam 320 throughout the rotation of the cam shaft. In an alternative embodiment, the spring 210 may bias the auxiliary rocker arm 200 toward the master piston 114. In such embodiments, extension of the master piston 114 from the piston bore 112 may cause the auxiliary rocker arm 200 to rotate backward against the bias of the spring 210 so that it may contact the auxiliary cam 320 only when the master piston is hydraulically extended.

In other embodiments, the rocker arms may include an intake rocker arm 100. The intake rocker arm 100 may be adapted to actuate an engine valve, such as an intake valve 400, by contacting it directly or through a valve bridge. The auxiliary rocker arm 200 may be adapted to selectively actuate at least one intake valve 400 by contacting the intake rocker arm 100, and acting through the intake rocker arm on the intake valve. It is contemplated that an intake cam may impart primary valve actuation motion to the intake rocker arm to provide a main intake event, and an auxiliary cam may impart auxiliary valve actuation motion to the auxiliary rocker arm 200 to provide auxiliary intake events, such as, for example, exhaust gas recirculation, and/or brake gas recirculation.

Operation in accordance with a first method embodiment of the present invention, using the system for actuating engine valves shown in FIGS. 1-4, will now be explained. With reference to FIGS. 1-4, engine operation causes the cam shaft 300 to rotate. The rotation of the exhaust cam 310 causes the exhaust rocker arm 100 to pivot about the rocker shaft 500 and actuate the exhaust valves 400 for main exhaust events in response to interaction between the main exhaust lobe 315 on the exhaust cam and the exhaust cam roller 102. Likewise, each lobe on the auxiliary cam 320 may cause the auxiliary rocker arm 200 to pivot about the rocker shaft 500 toward the master piston 114.

During positive power operation of the system, fluid pressure in the control fluid supply passage 520 may be vented or reduced, which in turn may cause fluid pressure in the control fluid passage 160 (see FIGS. 2 and 4) to vent or recede. With reference to FIG. 2, as a result, the internal fluid passages in the control valve piston 130 may cease to register with the port connecting the control valve bore 124 to the second fluid passage 162 as the control valve 130 translates into the control valve bore under the influence of the control valve spring 133. Fluid in the second fluid passage 162 may then vent past the rear of the control valve piston 130 and out of the control valve bore 124. As a result, with reference to FIG. 2, the master piston 114 may collapse into the master piston bore 112 under the influence of the master piston spring 120.

With reference to FIG. 3, the auxiliary rocker arm 200 may be biased toward the auxiliary cam 320 by the spring 210. As a result of the master piston 114 being biased into the bore 112 and the auxiliary rocker arm 200 being biased toward the auxiliary cam 320, a lash space may exist between the valve actuation end 206 of the auxiliary rocker arm 200 and the master piston when the auxiliary cam 320 is at base circle and fluid pressure in the fluid supply passage 520 is vented or reduced. Preferably, this lash space prevents the auxiliary rocker arm 200 from engaging the master piston 114 when the auxiliary rocker arm is pivoted by the lobe or lobes on the auxiliary cam 320. Thus, during positive power, movement of the auxiliary rocker arm 200 in response to the auxiliary cam 320 may not produce any actuation of the master piston 114.

When auxiliary exhaust valve actuation is desired for engine braking, EGR, and/or BGR, the fluid pressure in the control fluid supply passage 520 may be increased. A solenoid actuated valve (not shown) may be used to control the application of increased fluid pressure in the control fluid supply passage 520. Increased fluid pressure in the control fluid supply passage 520 is applied through the first fluid passage 160 in the exhaust rocker arm 100 to the control valve piston 130. When the auxiliary valve actuation is engine braking, for example, the control valve piston 130 may be displaced in the control valve bore 124 into an "engine brake on" position (shown in FIG. 4), wherein the internal fluid passages in the control valve piston 130 register with the second fluid passage 162. The check valve 140 may prevent fluid that enters the second fluid passage 162 from flowing back through the control valve piston 130. Fluid pressure in the second fluid passage 162 and third fluid passage 164 may be sufficient to overcome the bias force of the master piston spring 120. As a result, the master piston 114 may extend out of the bore 112 and take up the lash space between the master piston and the auxiliary rocker arm actuation en 206 when the auxiliary cam 320 is at base circle. As long as low pressure fluid maintains the control valve piston 130 in the "engine brake on" position, the master piston 114 may be in a hydraulically extended position. Thereafter, pivoting of the auxiliary rocker arm 200 by the auxiliary cam 320 may displace the master piston 114, which in turn displaces the slave piston 172 to produce a valve actuation for the exhaust valve 400 that is in contact with the sliding pin 460. The valve actuation may correspond to each lobe on the auxiliary cam (i.e., lobes 330, 340, and/or 350) because there is reduced or no lash space between the auxiliary rocker arm and the master piston.

When auxiliary exhaust valve actuation is no longer desired, pressure in the control fluid supply passage 520 may be reduced or vented and the control valve piston 130 will return to an "engine brake off" position. Fluid in the master piston bore 112 may then vent back through the third and second fluid passages 162 and 164 and out of the control valve bore 124.

It will be apparent to those skilled in the art that variations and modifications of the present invention can be made without departing from the scope or spirit of the invention. For example, it is appreciated that the exhaust rocker arm 100 could be implemented as an intake rocker arm, or an auxiliary rocker arm, without departing from the intended scope of the invention. Furthermore, various embodiments of the invention may or may not include a means for biasing the auxiliary rocker arm 200 toward either the auxiliary cam 320, or the master piston 114. Still further, the designation of a rocker arm as a "auxiliary" rocker arm is not intended to be limiting to its size or shape relative to any other rocker arm. These and other modifications to the above-described embodiments of the invention may be made without departing from the intended scope of the invention.

What is claimed is:

1. A system for actuating first and second engine valves associated with the same engine cylinder, comprising:

a rocker arm shaft;

a means for imparting primary valve actuation motion;

a primary rocker arm disposed on the rocker arm shaft, said primary rocker arm being adapted to actuate the first and second engine valves and receive motion from the means for imparting primary valve actuation motion;

a means for imparting auxiliary valve actuation motion;

an auxiliary rocker arm disposed adjacent to the primary rocker arm, said auxiliary rocker arm being adapted to receive motion from the means for imparting auxiliary valve actuation motion;

a master piston disposed in a master piston bore in the primary rocker arm;

a slave piston disposed in a slave piston bore in the primary rocker arm, said slave piston positioned so as to provide auxiliary valve actuation motion to only the first of the first and second engine valves;

a control valve disposed in a control valve bore in the primary rocker arm; and a hydraulic circuit connecting the master piston bore, the slave piston bore and the control valve bore.

2. The system of claim 1 further comprising:

a sliding pin disposed between the slave piston and the first engine valve, wherein the auxiliary valve actuation motion is transferred from the auxiliary rocker arm to the first engine valve through motion of the master piston, the slave piston, and the sliding pin.

3. The system of claim 2 further comprising:

a valve bridge extending between the first and second engine valves, said valve bridge having a side opening extending through a first end of the valve bridge above the first engine valve, wherein said sliding pin is disposed in the valve bridge side opening.

4. The system of claim 1 further comprising:

a valve bridge extending between the first and second engine valves, said valve bridge having a side opening extending through a first end of the valve bridge above the first engine valve; and a sliding pin disposed in the valve bridge side opening and extends between the first engine valve and the slave piston.

5. The system of claim 4 further comprising:

a master piston boss extending laterally from a main body of the primary rocker arm, said master piston boss being positioned below a valve actuation end of the auxiliary rocker arm and containing the master piston bore.

6. The system of claim 3 further comprising:

a master piston boss extending laterally from a main body of the primary rocker arm, said master piston boss being positioned below a valve actuation end of the auxiliary rocker arm and containing the master piston bore.

7. The system of claim 1 further comprising:

a master piston boss extending laterally from a main body of the primary rocker arm, said master piston boss being positioned below a valve actuation end of the auxiliary rocker arm and containing the master piston bore.

8. The system of claim 4 wherein the master piston extends from an upper surface of the primary rocker arm and the slave piston extends from a lower surface of the primary rocker arm.

9. The system of claim 3 wherein the master piston extends from an upper surface of the primary rocker arm and the slave piston extends from a lower surface of the primary rocker arm.

10. The system of claim 1 wherein the master piston extends from an upper surface of the primary rocker arm and the slave piston extends from a lower surface of the primary rocker arm.

11. The system of claim 1 further comprising:

an engine braking controller; and means for supplying the master piston bore, slave piston bore and hydraulic circuit with hydraulic fluid in response to a signal provided by the engine braking controller.

12. The system of claim 1 further comprising a check valve disposed in the control valve.

13. The system of claim 1 further comprising a control fluid supply passage provided in the rocker shaft and connecting to the hydraulic circuit.

14. The system of claim 1 further comprising a master piston spring biasing the master piston into the master piston bore.

15. The system of claim 1 further comprising a slave piston spring biasing the slave piston into the slave piston bore.

16. The system of claim 1 further comprising a means for biasing the auxiliary rocker arm toward the master piston.

17. The system of claim 1, wherein the auxiliary valve actuation motion is selected from the group consisting of: engine braking motion, exhaust gas recirculation motion, auxiliary intake motion, and brake gas recirculation motion.

18. A system for actuating first and second engine valves comprising:

a rocker arm shaft;

a primary rocker arm disposed on the rocker arm shaft, said primary rocker arm having a master piston boss extending laterally from a main body of the primary rocker arm, and having an engine valve actuation end;

an auxiliary rocker arm disposed adjacent to the main body of the primary rocker arm on a side of the primary rocker arm from which the master piston boss extends;

a master piston disposed in a master piston bore in the master piston boss;

a slave piston disposed in a slave piston bore in the main body of the primary rocker arm;

a valve bridge extending between the first and second engine valves, and having a center surface adapted to contact the primary rocker arm actuation end, said valve bridge further having a side opening extending through a first end of the valve bridge above the first engine valve;

a sliding pin disposed in the valve bridge side opening and extending between and contacting the first engine valve and the slave piston; and a hydraulic circuit connecting the master piston bore, the slave piston bore and a hydraulic fluid source.

19. The system of claim 18, further comprising a control valve disposed in the hydraulic circuit.

20. The system of claim 19 wherein the control valve is disposed in the primary rocker arm.

21. The system of claim 18 wherein the master piston extends from an upper surface of the primary rocker arm and the slave piston extends from a lower surface of the primary rocker arm.

22. A method of actuating first and second engine valves for primary and auxiliary valve actuation events using a primary rocker arm, an auxiliary rocker arm mounted adjacent to the primary rocker arm, and a master-slave hydraulic lost motion system incorporated into the primary rocker arm, said method comprising the steps of:

actuating the first and second engine valves for a primary valve actuation event responsive to motion imparted from a first valve train element to the primary rocker arm during a primary valve actuation mode of engine operation;

applying hydraulic fluid to the master-slave hydraulic lost motion system to extend master and slave pistons from the primary rocker arm during a time that an auxiliary valve actuation event is to be imparted to only the first of the first and second engine valves; and actuating only the first of the first and second engine valves for an auxiliary valve actuation event using the master-slave hydraulic lost motion system responsive to motion imparted from a second valve train element to the auxiliary rocker arm during an auxiliary valve actuation mode of engine operation.

23. The method of claim 22 wherein the auxiliary valve actuation event is selected from the group consisting of: a compression release engine braking event, an exhaust gas recirculation event, an intake valve event, and a brake gas recirculation event.

* * * * *